US005155541A

United States Patent [19]

Loce et al.

[11] Patent Number: 5,155,541

[45] Date of Patent: Oct. 13, 1992

[54] SINGLE PASS DIGITAL PRINTER WITH BLACK, WHITE AND 2-COLOR CAPABILITY

[75] Inventors: Robert P. Loce, Rochester, N.Y.; Richard F. Lehman, Nashua, N.H.

[73] Assignee: Xerox Corporation, Stamford, Conn.

[21] Appl. No.: 736,375

[22] Filed: Jul. 26, 1991

[51] Int. Cl.[5] ..... G03G 15/01

[52] U.S. Cl. ..... 355/328; 355/326; 355/327

[58] Field of Search ..... 355/326, 327, 328, 272

[56] References Cited

U.S. PATENT DOCUMENTS

| | | | |
|---|---|---|---|
| 3,816,115 | 6/1974 | Gundlach et al. | 96/1.4 |
| 3,832,170 | 8/1974 | Nagamatsu et al. | 96/1.2 |
| 4,068,938 | 1/1978 | Robertson | 355/4 |
| 4,078,929 | 3/1978 | Gundlach | 96/1.2 |
| 4,346,982 | 8/1982 | Nakajima et al. | 355/3 R |
| 4,403,848 | 9/1983 | Snelling | 355/4 |
| 4,562,129 | 12/1985 | Tanaka et al. | 430/42 |
| 4,562,130 | 12/1985 | Oka | 430/54 |
| 4,679,929 | 7/1987 | Haneda et al. | 355/326 X |
| 4,731,634 | 3/1988 | Stark | 355/37 R |
| 4,868,611 | 9/1989 | Germain | 355/328 |
| 4,908,287 | 3/1990 | Fukuchi et al. | 355/326 X |
| 4,927,724 | 5/1990 | Yamamoto et al. | 355/327 X |
| 4,959,695 | 9/1990 | Nishimura et al. | 355/327 |
| 5,045,893 | 9/1991 | Tabb | 355/328 |

*Primary Examiner*—A. T. Grimley
*Assistant Examiner*—Nestor R. Ramirez

[57] ABSTRACT

Method and apparatus for printing toner images in black and at least two highlighting colors in a single pass of the imaging surface through the processing areas of the printing apparatus. Imaging and development techniques of color photography and tri-level xerography are combined to produce images with black and two colors wherein the two highlighting colors are developed with only one color toner. A single imaging step forms a four level charge pattern on a charge retentive surface followed by development of two of the image levels using tri-level imaging techniques. Uniform exposure of the imaging surface, similar to that used to color photography techniques precedes development of the last image. The uniform exposure modifies the last developed image level and the background charge level allowing development of the last image with a single toner.

12 Claims, 3 Drawing Sheets

SINGLE PASS DIGITAL PRINTER WITH BLACK, WHITE AND 2-COLOR CAPABILITY

BACKGROUND OF THE INVENTION

This invention relates generally to methods and apparatus for rendering latent electrostatic images visible using multiple colors of dry toner or developer and more particularly to printing toner images in black and at least two highlighting colors in a single pass of the imaging surface through the processing areas of the printing apparatus while utilizing color photography and tri-level xerography techniques.

In the practice of conventional xerography, it is the general procedure to form electrostatic latent images on a xerographic surface by first uniformly charging a charge retentive surface such as a photoreceptor. Only the imaging area of the photoreceptor is uniformly charged. The image area does not extend across the entire width of the photoreceptor. Accordingly, the edges of the photoreceptor are not charged. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

Modern business and computer needs oftentimes make it advantageous and desirable to reproduce originals which contain two or more colors. It is sometimes important that the copy reproduced also contain two colors.

An accounting report having certain information highlighted in a second color is one example of a type of document which would desirably be copied in more than one color. Computer generated cathode ray tube (CRT) displays are another example in which it is sometimes desirable to reproduce an image in more than one color. For instance, it is sometimes desirable that those portions of the CRT display image representing permanent forms are reproduced in a first color and those portions of the image representing variable information are reproduced in a second color.

Several useful methods are known for making copies having plural colors. Some of these methods make high quality images, however, there is need for improvements. In particular, it is desirable to be able to print images having two or more highlight colors rather than being limited to a single highlight color. It is also desirable to be able to produce such images in a single pass of the photoreceptor or other charge retentive surface past the printing process areas or stations.

One method of producing images in plural (i.e. two colors, black and one highlight color) is disclosed in U.S. Pat. No. 3,013,890 To W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method of Bixby develops positively charged image areas with the negative toner and develops negatively charged image areas with the positive toner. A two-color image occurs only when the charge pattern includes both positive and negative polarities.

Plural color development of charge patterns can be created by the Tesi technique. This is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making color xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

Still another method of creating two-color images, as disclosed in U.S. Pat. No. 4,078,929, utilizes a charge pattern of only one polarity on an imaging surface. The charge pattern includes charged areas at one voltage level corresponding to background voltages and charged image areas at two other voltage levels different from the background level. One of the image voltages is greater in magnitude than the background voltage and the other is smaller in magnitude.

The charge pattern in the U.S. Pat. No. 4,078,929 is developed with toner particles of first and second color. The toner particles of one of the colors is positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

As disclosed in U.S. Pat. No. 4,403,848, a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

In U.S. Pat. No. 4,562,129 there is disclosed an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a nonmagnetic insulating toner and a high-resistivity magnetic carrier triboelectrically chargeable with the toner and having a high resistivity of at least $10^{12}$ ohm-cm, the carrier being in the form of particles about 5 to about 40 microns in size, prepared by dispersing a magnetic fine powder in an insulating resin and containing the magnetic fine powder in a proportion of 50 to 75% by weight.

U.S. Pat. No. 4,562,130 relates to a composite image forming method having the following features: (A) Forming a composite latent electrostatic image of potentials at three different levels by two image exposures, the potential of the background area (non-image area) resulting from the first image exposure is corrected to a stable intermediate potential which is constant at all times by charging the area with scorotron charging means. Accordingly, the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346,982, there is disclosed an electrophotographic recording device having means for uniformly charging the surface of a light-sensitive recording medium, means for forming latent images on said light-sensitive recording medium and means for developing said latent images into visual images, said electrophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

In tri-level, highlight color imaging, unlike conventional xerography as well as other printing processes, the image area contains three voltage levels which correspond to two image areas and to a background voltage area. One of the image areas corresponds to non-discharged (i.e. charged) areas of the photoreceptor while the other image areas correspond to discharged areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) stays at the full photoreceptor potential ($V_{cad}$ or $V_{ddp}$, shown in FIG. 1*a*). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ (about 600 v), and the DAD developer system is biased about 100 v ($V_{cb}$, shown in FIG. 1*b*) closer to $V_{dad}$ than $V_{white}$ (about 400 v).

U.S. Pat. No. 4,731,634 granted to Howard M. Stark on Mar. 15, 1988 discloses a method and apparatus for rendering latent electrostatic images visible using multiple colors of dry toner or developer and more particularly to printing toner images in black and at least two highlighting colors in a single pass of the imaging surface through the processing areas of the printing apparatus. A four level image is utilized for forming a black and two highlight color image areas and a background area, all having different voltage levels. Two of the toners are attracted to only one charge level on a charge retentive surface thereby providing black and one highlight color image while two toners are attracted to another charge level to form the second highlight color image.

As will be appreciated, the formation of black and two highlight color images using only one color toner for each of the three images is highly desirable. The foregoing would obviate the problems attendant the transfer of the larger toner masses involved in the '634 method and apparatus. Also, it would insure truer color replication which is highly desirable when reproducing company logos.

BRIEF SUMMARY OF THE INVENTION

Briefly, the present invention utilizes tri-level, highlight color imaging combined with a development technique similar to that used in color photography to provide a color imaging device and method capable of creating images in black and at least two highlighting colors in a single pass of the imaging surface through the processing areas of the printing apparatus. In color photography, a single imaging exposure is performed, then several development steps and a non-imaging uniform exposure are used to obtain a multicolor image. Tri-level xerography, as noted above, incorporates an imaging exposure and two types of development; Charged Area Development (CAD) and Discharge Area Development (DAD).

In practicing the invention, a four level Raster Output Scanner (ROS) is utilized, in a single imaging step, to form a four level latent electrostatic image including three image areas and a background area. The single imaging step is followed by the development of two of the image areas, one with black toner and one with a color toner. The two developed image areas and the remaining two non-developed areas (i.e. one image area and the background area) are then subjected to a uniform exposure. The areas of the photoconductor that have already been developed, are shielded from the light by the deposited toner, so, little or no discharge occurs in these areas. The uniform exposure step modifies the non developed image and background areas such that this image area gets developed with only the second color toner, the already developed images having been modified during development or thereof or otherwise modified so that no further development thereof occurs.

DETAILED DESCRIPTION OF THE PREFERRED EMBODIMENT OF THE INVENTION

Figure 1A:
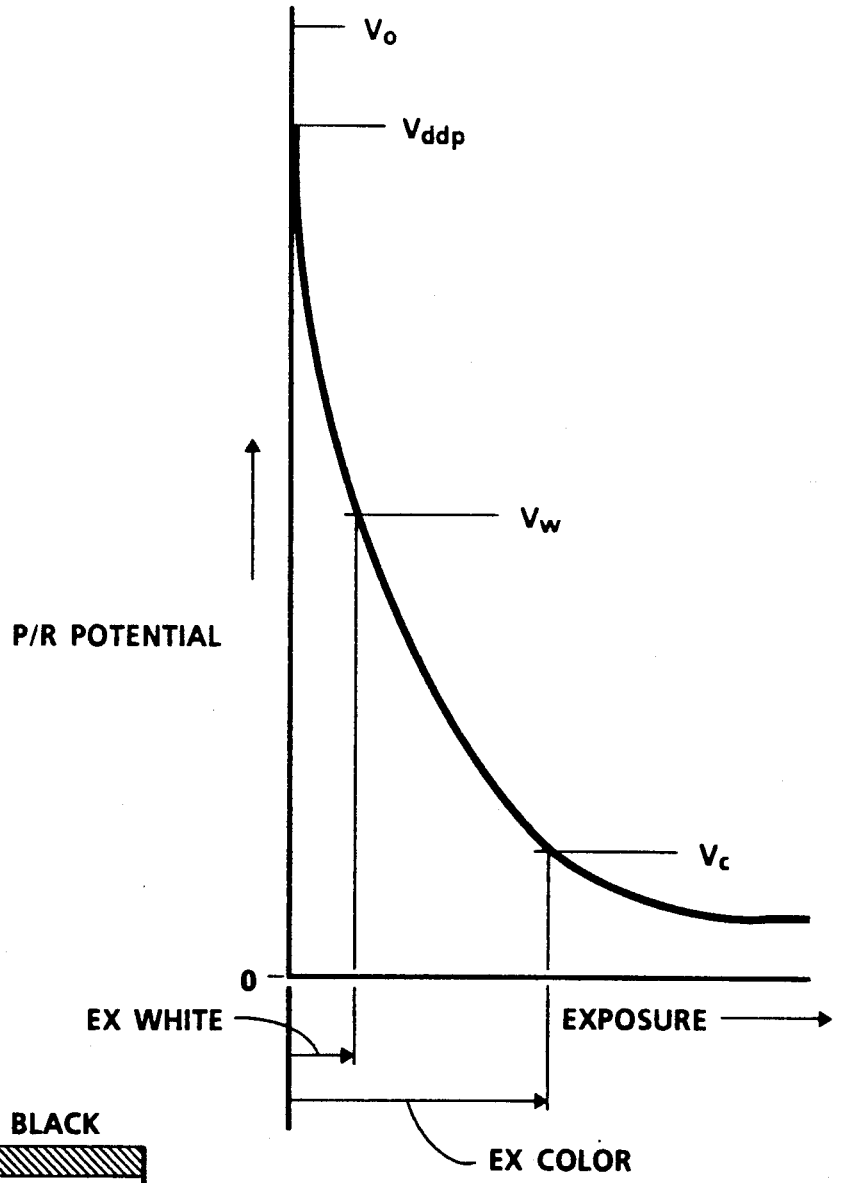
FIG. 1*a* is a plot of photoreceptor potential versus exposure illustrating a tri-level electrostatic latent image.
Figure 1B:
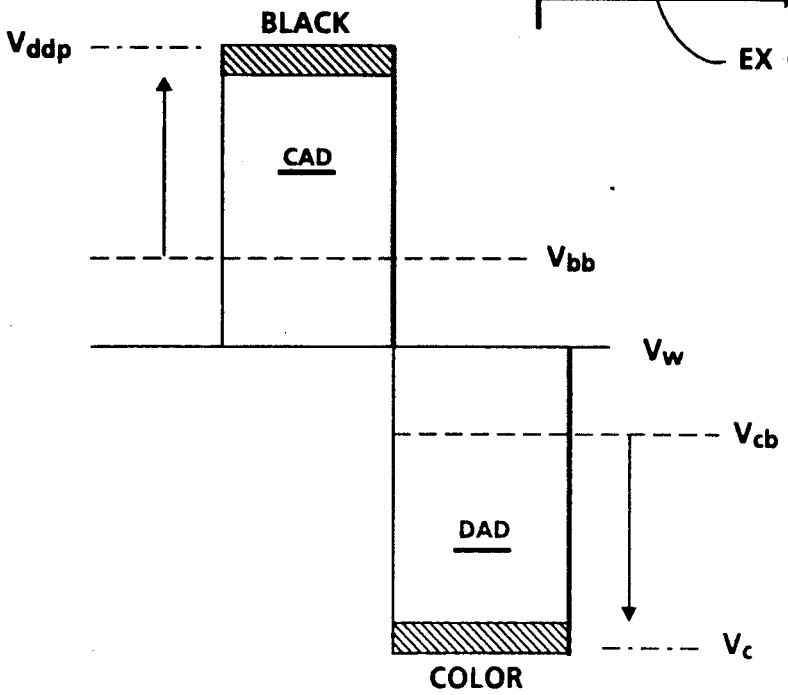
FIG. 1*b* is a plot of photoreceptor potential illustrating single-pass, highlight color latent image characteristics.
Figure 2:
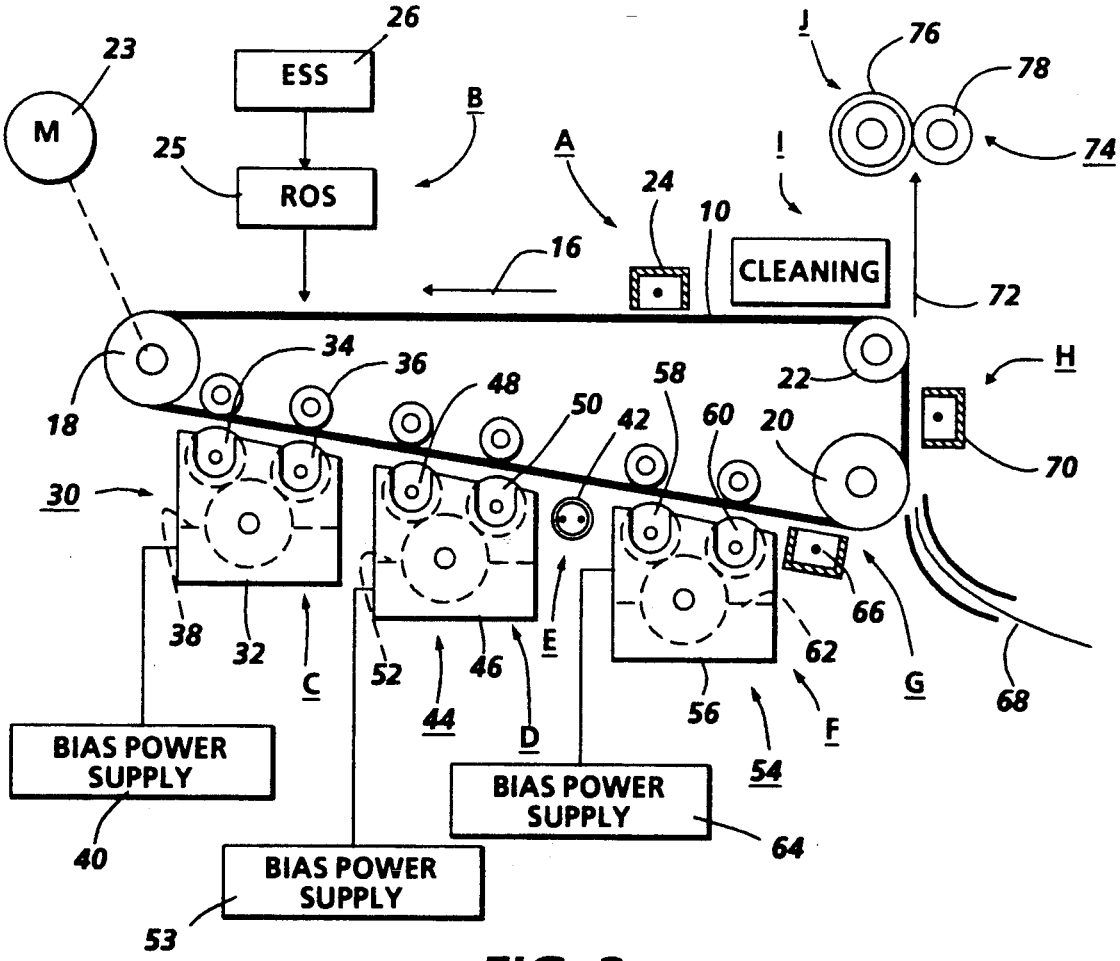
FIG. 2 is a schematic illustration of an imaging apparatus incorporating the inventive features of the invention.

As shown in FIG. 2, a printing machine incorporating the invention may utilize a charge retentive member in the form of a photoconductive belt 10 consisting of a photoconductive surface and an electrically conductive substrate and mounted for movement past a charging station A, an exposure station B, a first development station C, a second development station D, a uniform exposure station E, a third development station F a pre-transfer charging station G, a transfer station H, and a cleaning station I. Belt 10 moves in the direction of arrow 16 to advance successive portions thereof sequentially through the various processing stations disposed about the path of movement thereof for forming images in a single pass of the belt through all of the process stations. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive. A suitable belt structure is disclosed in U.S. Pat. No. 4,265,990 granted on May 5, 1981 to Stolka et al.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high (i.e. 1000 volts) uniform positive or negative potential, $V_0$. Any suitable control, well known in the art, may be employed for controlling the corona discharge device 24.

Figure 3:
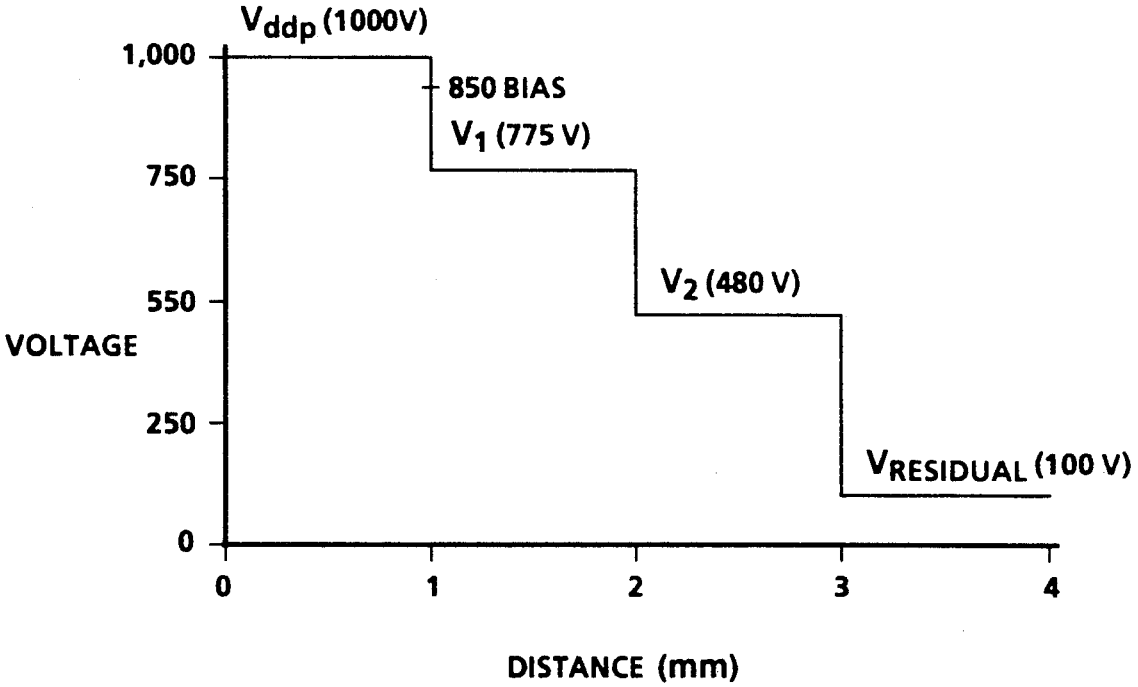
FIG. 3 is a plot of voltage level on a photoconductive surface versus relative position on the surface which depicts a four level latent image.
Figure 4:
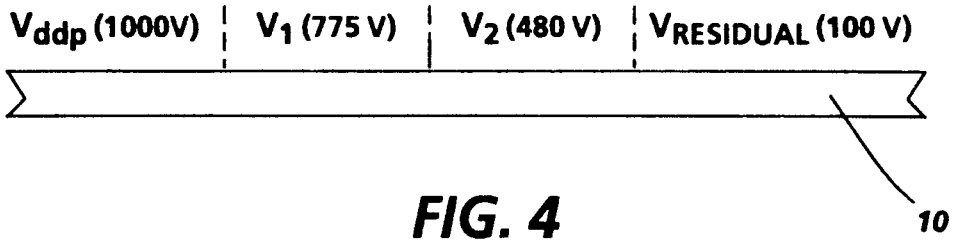
FIG. 4 is a schematic representation of a photoconductive surface depicting the four voltage levels thereon after a single imaging step.
Figure 7:
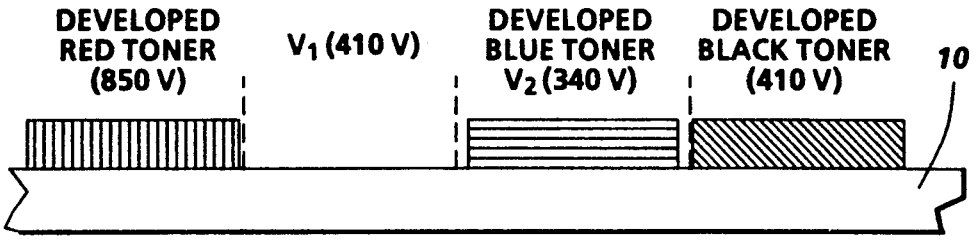
FIG. 7 is a schematic representation of a photoconductive surface depicting the voltages thereon following the development of the final image.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to remain charged or to be discharged in accordance with the output from the scanning device. Preferably the scanning device is a four-level (2 bit) Raster Output Scanner (ROS). An Electronic Sub-System (ESS) 26 converts a previously stored image into the appropriate control signals for the ROS in an imagewise fashion. Such exposure results in a photoreceptor containing four-level images such as that illustrated in FIGS. 3 and 4, the four voltage levels being equal to $-1000$ ($V_{ddp}$), $-775$ ($V_1$), $-480$ ($V_2$) and $-100$ ($V_{residual}$) volts by way of example. The four voltage levels correspond to three image areas and a background area. Three development apparatuses 30, 44 and 54 are provided for developing the three image areas with different color toners.

The $-1000$ , $V_{ddp}$ volt level results from the ROS being turned off at that region of the photoreceptor so no exposure and discharge occurs there. The $-100$ volt region received maximum exposure by the ROS so the photoconductor discharges to its residual voltage ($V_{residual}$). Intermediate voltage levels are obtained by using the ROS intermediate power levels. The exposure levels required for an AMAT photoconductor charged to −1000 volts are 0,1.1, 2.7 and 8.8 ergs/cm$^2$.

The next step is development of two of the voltage levels with, for example, negatively charged black toner and positively charged red toner. For developing the −1000 volt image level, electrical bias for a red developer housing 32 forming a part of conductive magnetic brush developer apparatus 30, is set to −850 V and Charged Area Development is used. This provides −150 volts for the development field and at least −75 volts as the cleaning field for effecting development of such images with red toner forming a part of a two component developer 38, the cleaning field serving to preclude development of background areas. The red toner is applied to the latent electrostatic images contained on the photoconductive surface 10 via magnetic brush rollers 34 and 36, the carrier of this two component developer 38 being selected such that the red toner is positively charged through triboelectric charging thereagainst.

Figure 5:
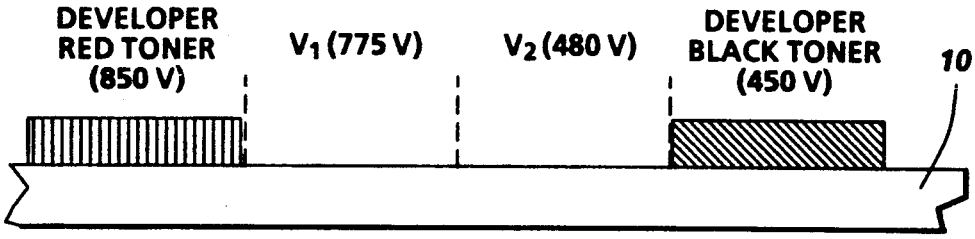
FIG. 5 is a schematic representation of a photoconductive surface depicting the four voltage levels thereon subsequent to the development of two of the three image levels thereon.

Setting the bias of a black developer housing 46 of conductive magnetic brush developer apparatus 44 to −410 volts and using Discharge Area Development provides a −310 volt development field and a −70 volt cleaning field for effecting development of $V_{residual}$ with negatively charged black toner forming part of a two component developer 52. Deposition of the black toner is effected via magnetic brush rollers 48 and 50. The condition of the photoconductor after these first two steps of development is shown in FIG. 5. Note that the developed patches will now have voltage levels approximately equal to the respective developer housing bias levels as the result of using Conductive Magnetic Brush (CMB) development since the primary development mechanism is charge neutralization.

Figure 6:
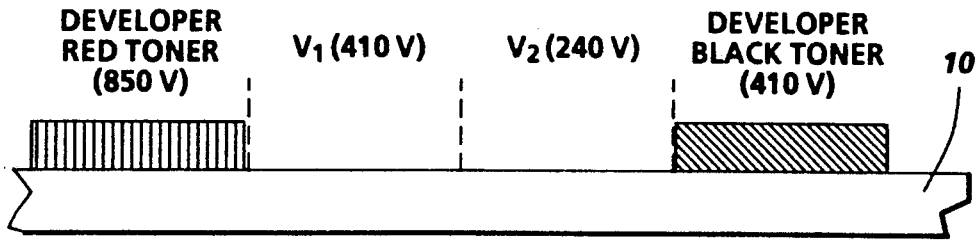
FIG. 6 is a schematic representation of a photoconductive surface depicting the voltages thereon subsequent to the uniform exposure thereof with two of three developed images thereon.

Next, a non-imaging uniform exposure is applied to the photoconductor with a well controlled light source such as a fluorescent lamp 42. The amount of exposure (2.1 ergs/cm$^2$) applied is sufficient to discharge the −480 volt region of the photoconductor to −240 volts. The −775 volt region will discharge to −410 volts. The areas of the photoconductor that have already been developed with red and black toners, are shielded from the light by the deposited toner, so, little or no discharge occurs in these areas. This is especially true in the black (very opaque) toner region where maintaining roughly a −410 volt level is important to achieve a sufficient cleaning field in the next development step. If necessary, the absorption spectra of the toners could be matched to the emission spectrum of the lamp to fully insure that discharge beneath the toner does not take place. The photoconductor after this stage of uniform exposure is shown in FIG. 6.

The final stage of development uses another colored toner, say blue, and Discharge Area Development with a bias level of −340 volts. The blue toner forms part of a two component developer 62 contained in conductive magnetic developer housing 56 of developer apparatus 54. The development and cleaning fields will be −100 volts and −70 volts respectively. The negatively charged blue toner is deposited on the blue image areas represented by voltage, $V_2$ utilizing magnetic brush rollers 58 and 60. The condition of the photoconductor after this stage of development is shown in FIG. 5.

As will be appreciated by those skilled in the art, while conductive magnetic brush development has been disclosed in order to take advantage of its inherent charge neutralization properties, scavengeless or non-interactive development as disclosed in U.S. Pat. No. 4,868,600 granted on Sep. 19, 1989 to Hays et al may be employed. If necessary the voltage levels of the red and black images voltage levels may be reduced to desired levels using corona discharge.

Because the composite image developed on the photoreceptor consists of both positive and negative toner, a typically positive pre-transfer corona discharge member 66 disposed at pre-transfer charging station G is provided to condition the toner for effective transfer to a substrate using positive corona discharge. The pre-transfer corona discharge member is preferably an ac corona device biased with a dc voltage to operate in a field sensitive mode and to perform tri-level xerography pre-transfer charging in a way that selectively adds more charge (or at least comparable charge) to the parts of the image that must have its polarity reversed compared to elsewhere. This charge discrimination may be enhanced by discharging the photoreceptor carrying the composite developed latent image with light before the pre-transfer charging begins. Furthermore, flooding the photoreceptor with light coincident with the pre-transfer charging minimizes the tendency to overcharge portions of the image which are already at the correct polarity.

A sheet of support material 68 is moved into contact with the toner image at transfer station H. The sheet of support material is advanced to transfer station H by conventional sheet feeding apparatus, not shown. Preferably, the sheet feeding apparatus includes a feed roll contacting the uppermost sheet of a stack copy sheets. Feed roll rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station H.

Transfer station H includes a corona generating device 70 which sprays ions of a suitable polarity onto the backside of sheet 68. This attracts the charged toner powder images from the belt 10 to sheet 58. After transfer, the sheet continues to move, in the direction of arrow 72, onto a conveyor (not shown) which advances the sheet to fusing station E.

Fusing station J includes a fuser assembly, indicated generally by the reference numeral 74, which permanently affixes the transferred powder image to sheet 68. Preferably, fuser assembly 74 comprises a heated fuser roller 76 and a backup roller 78. Sheet 68 passes between fuser roller 76 and backup roller 78 with the toner powder image contacting fuser roller 76. In this manner, the toner powder image is permanently affixed to sheet 68. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I. A magnetic brush cleaner housing is disposed at the cleaner station I.

Subsequent to cleaning, a discharge lamp (not shown) floods the photoconductive surface with light to dissipate any residual electrostatic charge remaining prior to the charging thereof for the successive imaging cycle.

In summary, a four level latent electrostatic image is formed on a uniformly charged (negatively) photoconductive surface using a four level ROS. The highest charge level is developed using, by way of example, red toner. The positively charged red developer housing is electrically biased negatively so that the positively charged red toner develops only the highest charge level. The red toner will not deposit on any area of the charge retentive surface having a charge level less than the red bias level. Since all the other charge levels are less than the red bias level, none of these levels is developed with red toner. This is because all the charge levels below the red developer bias are positive relative to the red toner, therefore, the positively charged red toner is repelled by all areas of charge below the red developer bias level.

The lowest charge level is developed using, by way of example, black toner. The negatively charged black developer housing is electrically biased negatively so that the negatively charged black toner develops only the lowest charge level. The black toner will not deposit on any area of the charge retentive surface with a charge level greater than the black developer bias level. Since all the other charge levels are greater than the black bias level, no black toner is deposited in any of these areas. This is because these other charge levels being at a negative charge level they repel the negatively charged black toner.

Uniformly exposing the charge retentive surface subsequent to the development of the red and black images results in reducing the two charge levels not already developed to levels at which the final image area can be developed with, by way of example, with blue toner. The exposure step reduces one of the "not already developed levels" to a level below the developed black image and one to a level approximately equal to the black image charge level. With a bias applied to the blue developer housing which is greater than the lower of the two non-developed levels but lower than all other charge levels, the negatively charged blue toner deposits only on the lowest charge level because that level is the only one that is at a positive charge level relative to the negative blue toner.

What is claimed is:

1. The method of forming color images on a charge retentive surface, said method including the following steps in the order recited:

uniformly charging said charge retentive surface;

exposing said uniformly charged surface to form a four level latent electrostatic charge pattern thereon;

developing a first one of said four levels to form a first toner image thereon;

developing a second one of said four levels to form a second toner image thereon;

uniformly exposing said charge retentive surface to a well controlled light source for altering the levels of the two levels not yet developed;

developing a third one of said four levels without developing said first and second ones of said four levels and a fourth level to form a third toner image thereon; and transferring said toner images simultaneously to a substrate.

2. The method according to claim 1 wherein the first image development utilizes the highest charge level and said second image development utilizes the lowest charge level and said first and second toners have opposite charge polarities.

3. The method according to claim 2 wherein said step of uniformly exposing said charge retentive surface comprises reducing the charge level of said third one of said levels and the charge level of the fourth level of said four level latent electrostatic charge pattern whereby said third one of said levels is the lowest of said first, fourth and third levels but higher than said second level.

4. The method according to claim 3 wherein said first, second and third toners are all different colors.

5. The method according to claim 4 wherein said second and third toners have the same polarity and said first toner has the opposite polarity.

6. The method according to claim 5 including the step of treating at least one of said toners so that all of said toners have the same polarity prior to the transfer step.

7. Apparatus for forming color images on a charge retentive surface in a single pass, said apparatus comprising:

means for uniformly charging said charge retentive surface;

means for exposing said uniformly charged surface to form a four level latent electrostatic charge pattern thereon;

means for developing a first one of said four levels fo form a first toner image thereon;

means for developing a second one of said four levels to form a second toner image thereon;

means for uniformly exposing said charge retentive surface to a well controlled light source for altering the levels of the two levels not yet developed;

means for developing a third one of said four levels without developing said first and second ones of said four levels and a fourth level to form a third toner image thereon; and means for transferring said toner images simultaneously to a substrate.

8. Apparatus according to claim 7 wherein the first image development utilizes the highest charge level and said second image development utilizes the lowest charge level and said first and second toners have opposite charge polarities.

9. Apparatus according to claim 8 wherein said means for uniformly exposing said charge retentive surface comprises means for reducing the charge level of said third one of said levels and the charge level of the fourth level of said four level latent electrostatic charge pattern whereby said third one of said levels is the lowest of said first, fourth and third levels but higher than said second level.

10. Apparatus according to claim 9 wherein said first, second and third toners are all different colors.

11. Apparatus according to claim 10 wherein said second and third toners have the same polarity and said first toner has the opposite polarity.

12. Apparatus according to claim 11 including means for treating at least one of said toners so that all of said toners have the same polarity prior to the transfer step.

* * * * *